US007422005B2

(12) United States Patent
Hardy et al.

(10) Patent No.: US 7,422,005 B2
(45) Date of Patent: Sep. 9, 2008

(54) SYSTEM AND METHOD FOR OPERATING A PIEZOELECTRIC FUEL INJECTOR

(75) Inventors: Martin P Hardy, Gillingham (GB); Christopher A Goat, North Meadow Offham (GB); Michael P Cooke, Gillingham (GB); Andrew John Hargreaves, Boughton Under Blean (GB); Jean-Francois Berlemont, Bascharage (LU)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/805,384

(22) Filed: May 22, 2007

(65) Prior Publication Data

US 2007/0273245 A1 Nov. 29, 2007

(30) Foreign Application Priority Data

May 23, 2006 (GB) ..... 0610231.3
Nov. 23, 2006 (EP) ..... 06256001

(51) Int. Cl.
*F02D 41/20* (2006.01)

(52) U.S. Cl. ..... 123/490

(58) Field of Classification Search ..... 123/490, 123/498, 479; 310/316.03
See application file for complete search history.

(56) References Cited

U.S. PATENT DOCUMENTS 7,305,971 B2 * 12/2007 Fujii ..... 123/490
2003/0150429 A1 * 8/2003 Rueger ..... 123/490

FOREIGN PATENT DOCUMENTS

| | | |
|---|---|---|
| DE | 103 11 269 | 9/2004 |
| DE | 10 2004 058971 | 6/2006 |
| WO | 2005/071248 | 8/2005 |
| WO | WO 2007/082627 A2 * | 7/2007 |

OTHER PUBLICATIONS

European Search Report dated Jun. 4, 2007.

* cited by examiner

*Primary Examiner*—Hieu T Vo
(74) *Attorney, Agent, or Firm*—David P. Wood

(57) ABSTRACT

A method of operating a fuel injector including a piezoelectric actuator having a stack of piezoelectric elements, comprises applying a discharge current ($I_{DISCHARGE}$) to the actuator for a discharge period so to discharge the stack from a first differential voltage level across the stack to a second, lower differential voltage level across the stack so as to initiate an injection event, and applying a charge current ($I_{CHARGE}$) to the actuator for a charge period (T3 to T4') so as to charge the stack from the second differential voltage level to a third differential voltage level so as to terminate the injection event. The method includes determining at least one engine parameter (e.g. common rail pressure) of the injection event prior to applying the charge current ($I_{CHARGE}$) to the actuator and selecting the third differential voltage level in dependence on the at least one engine parameter.

20 Claims, 3 Drawing Sheets

SYSTEM AND METHOD FOR OPERATING A PIEZOELECTRIC FUEL INJECTOR

TECHNICAL FIELD

The invention relates to a method of operating a piezoelectric fuel injector. More specifically, the invention relates to a method of operating a piezoelectric fuel injector in order to improve its operational life. The invention also relates to a drive arrangement for implementing such a method.

BACKGROUND TO THE INVENTION

In an internal combustion engine, it is known to deliver fuel into the cylinders of the engine by means of a fuel injector. One such type of fuel injector that permits precise metering of fuel delivery is a so-called 'piezoelectric injector'. Typically, a piezoelectric injector includes a piezoelectric actuator that is operable to control an injection nozzle. The injection nozzle houses an injector valve needle which is movable relative to a valve needle seating under the control of the actuator. A hydraulic amplifier is situated between the actuator and the needle such that axial movement of the actuator causes an amplified axial movement of the needle. Depending on the amount of charge applied to, or removed from, the piezoelectric actuator, the valve needle is either caused to disengage the valve seat, in which case fuel is delivered into the associated engine cylinder through outlets provided in a tip of the nozzle, or is caused to engage the valve seat, in which case fuel delivery through the outlets is prevented. The amount of charge is varied causing the valve needle to move between closed and open positions.

The amount of charge applied to and removed from the piezoelectric actuator can be controlled in one of two ways. In a charge control method, a current is driven into or out of the piezoelectric actuator for a period of time so as to remove or add, respectively, a demanded charge to or from the stack, respectively. Alternatively, in a voltage control method a current is driven into or out of the piezoelectric actuator until the voltage across the piezoelectric actuator reaches a demanded level. In either case, the voltage across the piezoelectric actuator changes as the level of charge on the piezoelectric actuator varies, and vice versa.

In order to initiate an injection of fuel, the drive circuit causes the differential voltage across the actuator terminals to transition from a high level at which no fuel delivery occurs to a relatively low level to initiate fuel delivery. An injector responsive to this drive waveform is referred to as a 'de-energise to inject' injector. When in a non-injecting state, in which the actuator spends most of its life, the voltage across the de-energise-to-inject injector is therefore relatively high and when in an injecting state the voltage across the actuator is relatively low.

It has now been recognised that the existence of such a high voltage across the actuator terminals for a relatively long portion of the injection cycle may adversely affect the injector. This is thought to be attributable, in part, to the fact that the higher the voltage across the injector, the higher the stress the actuator is subjected to when in a non-injecting state. It is also suspected that a high voltage across the terminals may encourage the permeation of ionic species into the actuator though its protective actuator encapsulation. In any event, inaccuracies in fuel volume delivery have a detrimental effect on combustion efficiency and lead to worse fuel economy and increased exhaust emissions.

It is an object of the invention to provide a method of operating a piezoelectric fuel injector so as to reduce or alleviate the aforementioned disadvantages.

SUMMARY OF THE INVENTION

According to a first aspect of the invention, there is provided a method of operating a fuel injector including a piezoelectric actuator having a stack of piezoelectric elements, the method comprising applying a discharge current to the actuator for a discharge period so as to discharge the stack from a first differential voltage level across the stack to a second differential voltage level across the stack so as to initiate an injection event, and applying a charge current to the actuator for a charge period so as to charge the stack from the second differential voltage level to a third differential voltage level so as to terminate the injection event. At least one engine parameter of the injection event is determined (e.g. measured) prior to applying the charge current to the actuator and the third differential voltage level is selected in dependence on the at least one engine parameter.

In one embodiment, the at least one engine parameter is determined by measuring the at least one engine parameter prior to the start of the discharge period (discharge phase) of an injection event and the subsequent charging phase of that injection event is then adjusted accordingly.

Alternatively, the at least one engine parameter is determined by measuring the at least one engine parameter during the discharge period or after the discharge period, but still prior to the subsequent charge period.

The invention selects the third differential voltage level to which the stack is recharged at the end of an injection event in dependence on one or more engine parameters. The third differential voltage level across the stack may be varied as a function of fuel pressure within the common rail of the engine (referred to as rail pressure). For example, if fuel pressure is relatively low, the third differential voltage level to which the stack is recharged to terminate the injection event is set at a lower level than if fuel pressure is relatively high.

Typically, the injector includes a valve needle which is operable by means of the piezoelectric actuator to engage and disengage from a valve needle seating so as to control the injection of fuel into the engine. The magnitude of the voltage drop across the stack determines the extent of displacement of the stack and, hence, the extent of displacement of the valve needle. If the voltage across the terminals is reduced, the magnitude of actuator displacement will also be reduced. To get the same amount of needle lift you need more actuator displacement at high rail pressures than at low pressures because the forces trying to close the needle increase with pressure. Therefore, implementing the method of the invention at low rail pressures does not compromise needle lift to the detriment of injector operation, but does allow the injector to be operated more efficiently.

If rail pressure is relatively low, for example, absolute valve needle displacement is not critical to injector operation and so the stack can be recharged to a lower differential voltage level (the third differential voltage level) than the first differential voltage level (the differential voltage at the start of discharge) without compromising injector performance. By reducing the voltage drop across the stack under such circumstances, the actuator is subjected to a reduced stress when in a non-injecting state which benefits injector life. Also, the permeation of ionic species into the actuator though the protective actuator encapsulation will tend to be reduced when there is a lower voltage drop across the stack.

As an alternative to varying the third differential voltage level in dependence on rail pressure, the third differential voltage level may be varied as a function of engine load, engine speed or throttle position, for example, or a combination of more than one of the aforementioned engine parameters.

In one embodiment, the method includes selecting a charge time for which the charge current is applied so as to achieve the third differential voltage level. This is carried out subsequent to the selection of the third differential voltage level in dependence on the one or more engine parameters.

In another embodiment, the third differential voltage level to which the stack is recharged can be adjusted by adjusting the level of a voltage source (e.g. a high voltage rail) for applying a differential voltage across the stack.

It may be convenient for the third differential voltage level to be selected from a look-up table or data map of calibration data.

The third differential voltage level may be a step-change function of the at least one engine parameter or may be a linear function of the at least one engine parameter.

According to a second aspect of the invention, there is provided a drive arrangement, for example forming part of a control unit, for a fuel injector including a piezoelectric actuator having a stack of piezoelectric elements, the drive arrangement comprising a first element(s) for applying a discharge current to the actuator for a discharge period so as to discharge the stack from a first differential voltage level across the stack to a second differential voltage level across the stack so as to initiate an injection event, and a second element(s) for applying a charge current the actuator for a charge period so as to charge the stack from the second differential voltage level to a third differential voltage level so as to terminate the injection event. A third element(s) determines at least one engine parameter prior to applying the charge current to the actuator such that the third differential voltage level to which the stack is charged is selected in dependence on the at least one engine parameter.

The first, second and third elements of the drive arrangement may be separate elements, or may be integral with one another. For example, the elements may be part of the same circuit board.

According to a third aspect of the invention, there is provided a computer program product comprising at least one computer program software portion which, when executed in an executing environment, is operable to implement the method of the first aspect of the invention.

According to a fourth aspect of the invention, there is provided a data storage medium having the or each computer software portion of the third aspect of the invention stored thereon.

According to a fifth aspect of the invention, there is provided a microcomputer provided with the data storage medium of the fourth aspect of the invention.

BRIEF DESCRIPTION OF THE DRAWINGS

The invention will now be described, by way of example only, with reference to the following figures in which.

DETAILED DESCRIPTION OF PREFERRED EMBODIMENTS

Figure 1:
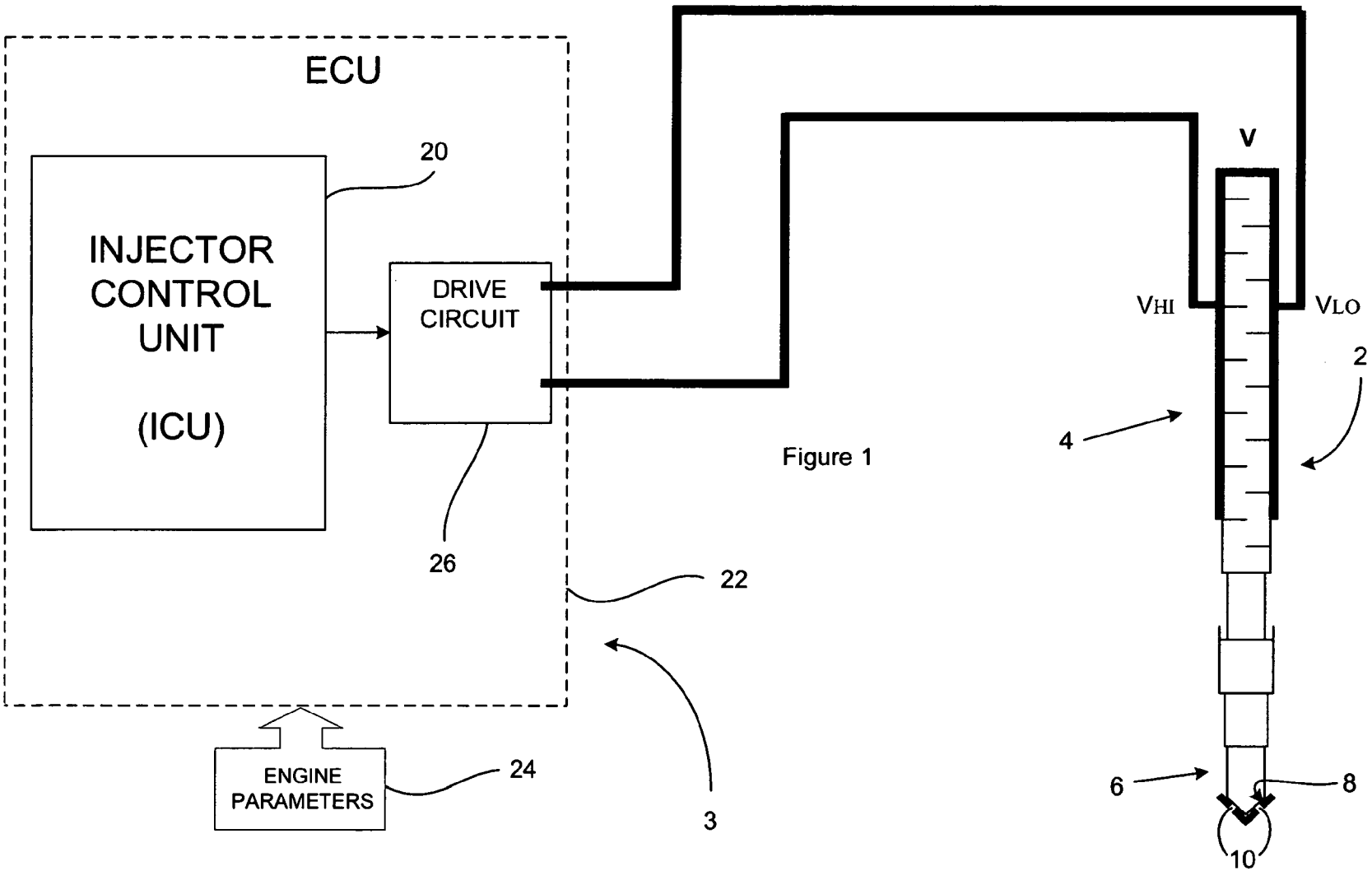
FIG. 1 shows a fuel injection system including a piezoelectric injector and an engine control unit (ECU)

With reference to FIG. 1, a piezoelectric injector 2 includes a piezoelectric actuator 4 having a stack of piezoelectric elements (not identified). The piezoelectric actuator 4 is operable to control the position of an injector valve needle 6 relative to a valve needle seating 8. Depending on the voltage across the terminals of the piezoelectric actuator 4, the valve needle 6 is either caused to disengage the valve needle seating 8, in which case fuel is delivered into an associated combustion chamber (not shown) through a set of nozzle outlets 10, or is caused to engage the valve needle seating 8, in which case fuel delivery is prevented.

The piezoelectric injector 2 is controlled by an injector control unit (ICU) 20 that forms an integral part of an engine control unit (ECU) 22. The ECU 22 continuously monitors a plurality of engine parameters 24 and feeds an engine power requirement signal to the ICU 20. The ICU 20 calculates a demanded injection event sequence to provide the required power for the engine and operates an injector drive circuit 26 of the ECU 22 accordingly. In turn, the injector drive circuit 26 causes a current to be applied to or removed from the injector to achieve the demanded injection event sequence.

Figure 2:
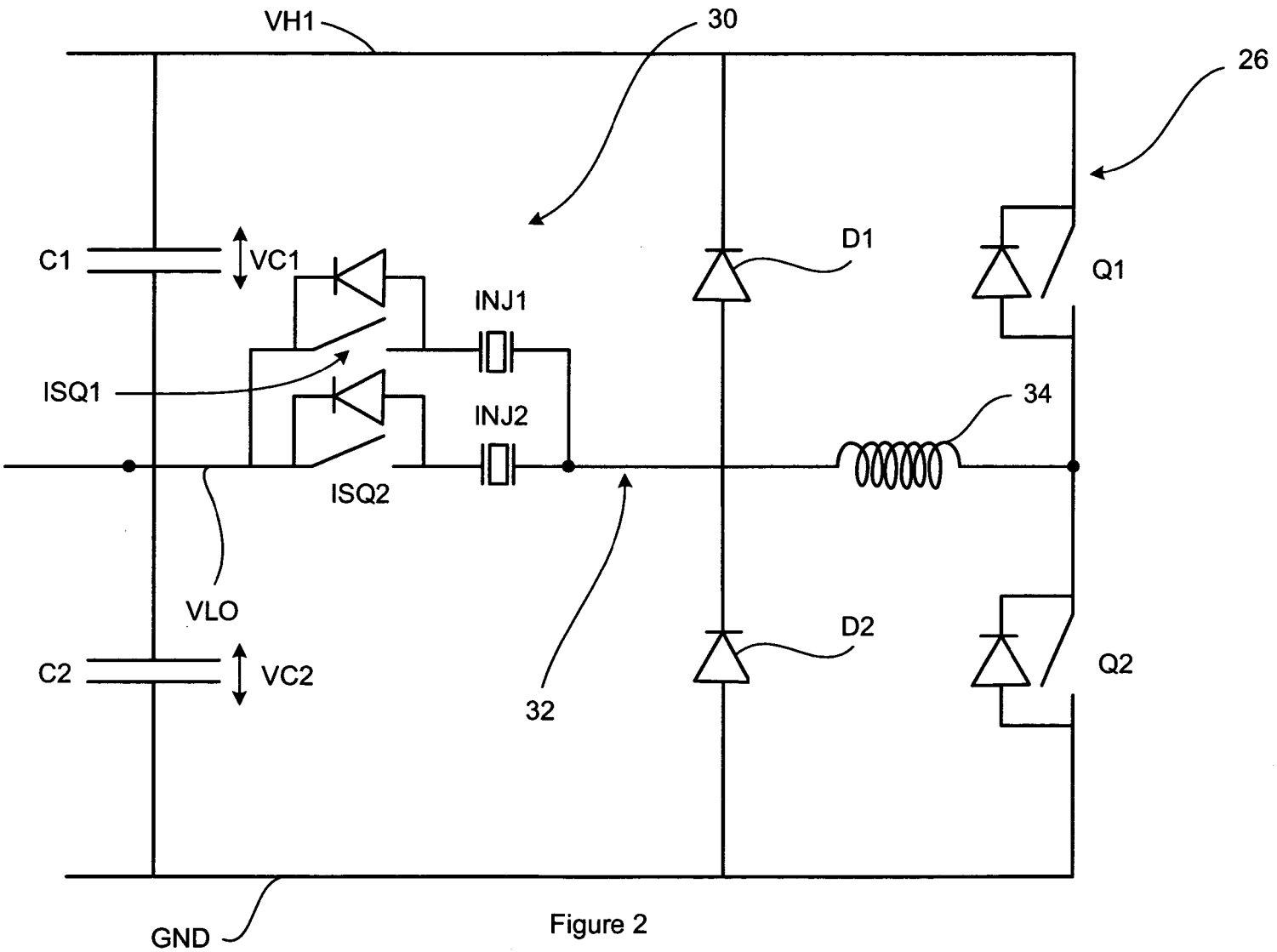
FIG. 2 shows an injector drive circuit forming part of the fuel injection system in FIG. 1.

The injector drive circuit 26 is shown in more detail in FIG. 2. The drive circuit 26 includes a high voltage rail $V_{HI}$ and a low voltage rail $V_{LO}$, at approximately +250 and +50 V respectively, and a ground potential rail GND. A first energy storage capacitor C1 is connected between the high voltage rail $V_{HI}$ and a middle current path 32, and a second storage capacitor C2 is connected between the middle current path 32 and the ground potential rail GND. An inductor 34 is connected in the middle current path 32. The voltage across the first storage capacitor is $V_{C1}$ and the voltage across the second storage capacitor is $V_{C2}$.

An injector bank network 30 comprising first and second piezoelectric injectors, INJ1 and INJ2 respectively, is connected between the high and low voltage rails, $V_{HI}$ and $V_{LO}$, of the injector drive circuit and in series with the inductor 34. During a non-injecting state, a differential voltage of approximately +200V is applied across the terminals of the first and second injectors INJ1, INJ2. In the non-injecting state this differential voltage is the difference in voltage between the voltage rails $V_{HI}$ and $V_{LO}$.

A diode D1 is provided between the middle current path 32 on the injector side of the inductor L1 and the high voltage rail $V_{HI}$, and another diode D2 is provided between the ground potential rail GND and the middle current path 32, again, on the injector side of the inductor L1. In use, the diode D1 provides a 'voltage clamping effect' for a selected injector INJ1 or INJ2 at the end of its charge phase and prevents the injector INJ1, INJ2 from being driven to voltages higher than $V_{C1}$. The diode D2 provides a recirculation path for current flow during the discharge phase of operation, as described in further detail below.

The injector bank network 30 further includes first and second injector select switches ISQ1, ISQ2. The injector drive circuit 26 also includes an injector charge select switch Q1 and an injector discharge select switch Q2 by which means either of the injectors INJ1, INJ2 may be selected for charge or discharge operation.

The injector drive circuit 26 illustrated in FIG. 2 is of a type known in the prior art and is described in further detail in, for example, the following European patent applications: EP 06255815.0, EP 06254039.8 and EP 06253619.8. By controlling the injector select switches ISQ1, ISQ2, the charge switch Q1, and the discharge switch Q2, it is possible to drive a varying current through the injectors INJ1, INJ2, for a required time, such that the actuator of a selected injector is charged/discharged, and fuel delivery is controlled accordingly. It will be appreciated that although the injector drive circuit 26 is shown in FIG. 2 as forming an integral part of the ECU 22, this need not be the case and the injector drive circuit 26 may be a separate unit from the ECU 22.

During an injection event sequence having a single, main injection of fuel from the first injector INJ1, it is known to operate the injector drive circuit 26 in the following manner.

When in a non-injecting state the first injector select switch ISQ1 is open and both the charge and discharge select switches Q1, Q2 are open. During this stage of operation the differential voltage across the terminals of the actuator 4 is at a first differential voltage level of around 200V. In order to cause the first injector INJ1 to deliver fuel, the first injector select switch ISQ1 is activated (closed) and the injector discharge select switch Q2 is activated (closed). This causes charge to flow out of the injector INJ1, through the inductor L1 and the discharge select switch Q2 to the ground potential rail GND. The injector drive circuit 26 determines, from a look-up table stored in a memory of the ECU 22, a demanded discharge time for which the discharge current is transferred from the actuator. This is referred to as the discharge phase. Once the discharge time has elapsed, the injector discharge switch ISQ1 is deactivated (opened) to terminate charge transfer. As a result of the charge transfer, the differential voltage across the injector INJ1 is decreased to a relatively low, second differential voltage level. Typically, the second differential voltage level is between −30V and −50V.

The differential voltage across the actuator will remain, or 'dwell', at the second differential voltage level for a relatively brief period during which the injector is injecting fuel.

In order to terminate an injection event, the injector charge switch Q1 is activated to cause charge to flow from the high voltage rail $V_{HI}$, through the charge select switch Q1 and into the injector INJ1, thus re-establishing a differential voltage of about +200V across the terminals of the injector INJ1. This is referred to as the charge phase. The time for which the injector charge switch Q1 is activated to cause the voltage across the injector to increase back to the initial differential voltage level is based on the discharge time of the previous discharge phase so as to ensure that the actuator is fully charged at the end of the injection event.

Figure 3:
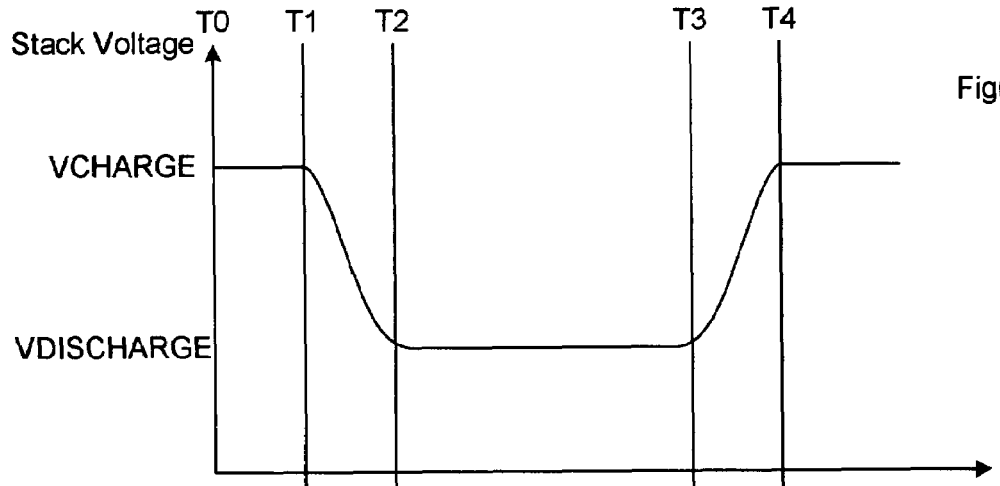
FIG. 3 is a voltage profile for an injection event sequence for implementation by the injector drive circuit in FIG. 2.
Figure 4:
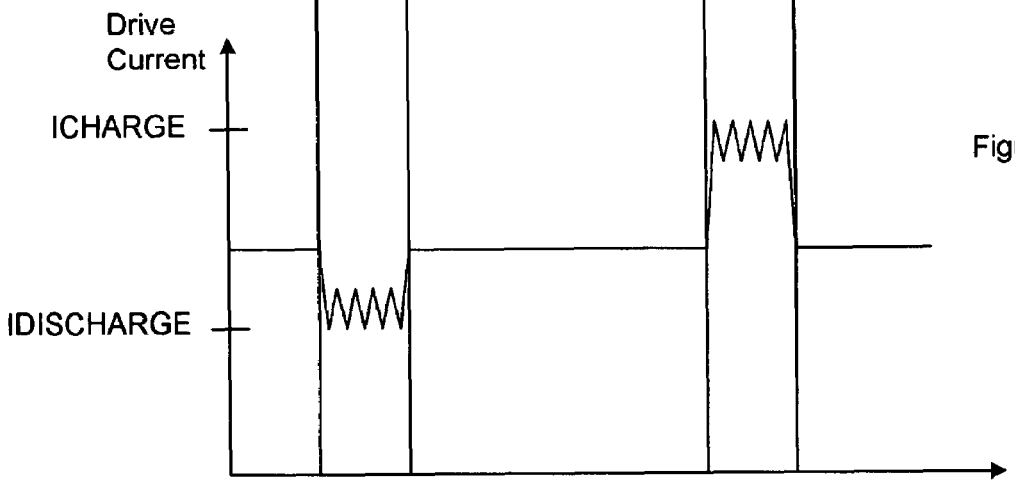
FIG. 4 is an idealised drive current profile corresponding to the voltage profile in FIG. 3.

FIG. 3 represents the voltage profile of a typical injection event comprising a single injection of fuel, as described above. FIG. 4 represents the drive current profile corresponding to the voltage profile in FIG. 3. At time T1 a discharge phase is initiated by driving a PWM (pulse width modulated) discharge current, at RMS current level $I_{DISCHARGE}$, through the injector for the time period T1 to T2. The discharge current is turned off at the end of the discharge phase, at time T2, and the injector remains in the dwell phase until time T3. Between time T2 and time T3 the injector is injecting fuel. At time T3 a PWM charge current, at RMS current level $I_{CHARGE}$, is supplied to the injector for a charge phase, until time T4 when the charge current $I_{CHARGE}$ is turned off and the injector is returned to its non-injecting state.

It will be appreciated that because the injector spends the majority of its service life in a non-injecting state, using the aforementioned method of operation it spends the majority of its service life with a high differential voltage across the actuator terminals. As discussed previously, this is prejudicial to injector performance. The method of the invention is implemented by the drive circuit in FIGS. 1 and 2 but improves on the aforementioned method by recognising that, in certain circumstances, the differential voltage across the actuator terminals need not be returned, at the end of the charging phase, to the high differential voltage level of the initial, non-injecting state.

Figure 5:
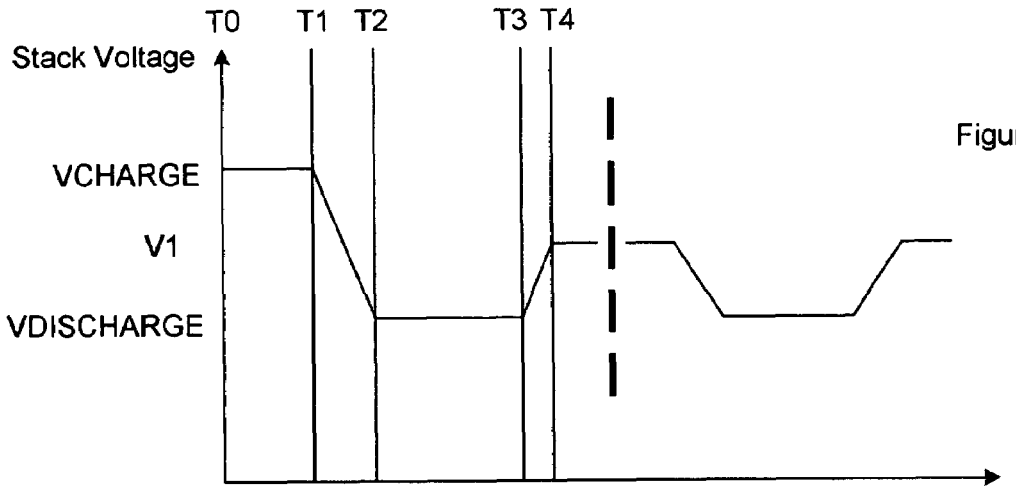
FIG. 5 is a voltage profile for an injection event sequence, in accordance with an embodiment of the present invention.

Referring to FIG. 5, initially at time T0 the injector is in a non-injecting state in which the differential voltage across the actuator is around +200V. At this time the pressure of fuel in the common rail (rail pressure) is determined from a rail pressure sensor signal provided to the ECU 22. At time T1, as described previously, a discharge current $I_{DISCHARGE}$ is removed from the actuator, between T1 and T2, so as to remove the demanded amount of charge from the actuator, thereby reducing the differential voltage across the actuator to a relatively low voltage level of around −30V. The differential voltage may be reduced to as much as −50V or, for smaller values of needle lift, may be reduced to around 0V. The discharge current $I_{DISCHARGE}$ is determined by, for example, rail pressure and stack temperature.

At the end of the discharge phase, at time T2, the discharge current $I_{DISCHARGE}$ is removed and the actuator remains in the dwell phase until time T3. Between time T2 and time T3 the injector is injecting fuel. If the rail pressure measured at the start of the injection event is below a predetermined level, the ECU 22 determines that it is not necessary to re-establish the initial, relatively high differential voltage across the actuator 4 at the end of the charge phase. Instead, the charge current, $I_{CHARGE}$, is only supplied to the actuator for a reduced time period (i.e. T3 to T4') so that the differential voltage across the actuator at the end of the charge phase (i.e. at the end of injection) is lower than the differential voltage at the start of the discharge phase (i.e. at the start of injection). The ECU 22 selects an appropriate, reduced charging time from data stored in its memory by first determining (from a look-up table or data map) the differential voltage that is required across the actuator 4 for the measured rail pressure. The ECU 22 then determines (from a look-up table or data map) the appropriate charging time that will result in this differential voltage across the actuator. In an open loop charge control strategy, the charge current is applied for the selected charging time to achieve the desired differential voltage. As the charge current is not controlled on voltage, at the end of the charge phase further current pulses are applied to the actuator to correct the differential voltage level, if necessary.

For as long as the pressure in the rail remains below the predetermined threshold level, for subsequent injections the actuator is then operated between a reduced differential voltage at the start of injection and the same, reduced differential voltage at the end of injection, as indicated by the injection event following time T4' in FIG. 5.

If, prior to a later injection event, it is determined that the rail pressure has increased above the predetermined threshold, the charge current $I_{CHARGE}$ is applied to the actuator, under the control of the ECU 22, for an increased time period (e.g. equivalent to T3 to T4 in FIG. 3) so as to re-establish the initial high differential voltage level of around +200V across the actuator 4 at the end of the charging phase.

In the aforementioned method of the invention the differential voltage across the injector is varied in a step-change manner through appropriate adjustment of the charge time. In a more specific example, if, at the start of an injection event just prior to applying the charge current, $I_{CHARGE}$, the measured rail pressure is less than 500 bar, the charge time (T3 to T4') is selected so that the differential voltage across the actuator at the end of the injection event is +180V. However, if the measured rail pressure is greater than or equal to 500 bar, the charge time (T3 to T4') is selected so that the differential voltage across the actuator at the end of the injection event is +200V. The ECU 22 performs the task of monitoring the rail pressure and selecting the differential voltage across the injector, and hence the charge time, depending on the rail pressure.

By way of example, it is likely that at full rail pressure a differential voltage of +200V is applied across the actuator terminals in the non-injecting state, with the differential voltage being reduced to −50V to initiate an injection. At the lowest rail pressure, the differential voltage across the actuator terminals need only be about +180V for the non-injecting state, with the differential voltage being reduced to 0V to initiate an injection. The optimum levels of the differential voltage will be dependent upon, for example, the injector design and the nature of the piezoelectric actuator.

The benefit of the invention is that the actuator spends a reduced period of time with a high differential voltage across the actuator terminals, so that the actuator is subjected to a reduced stress.

Although the magnitude of actuator displacement will also be reduced for a reduced voltage drop across the terminals (i.e. between non-injecting voltage and injecting voltage), at low values of rail pressure a reduced actuator displacement is required, compared to high values of rail pressure, and so valve needle lift is not affected. If rail pressure is relatively low, for example, absolute valve needle displacement is not critical to injector operation and so the stack can be recharged to a lower differential voltage without compromising injector performance.

In an alternative embodiment to that described previously, the differential voltage across the injector may be varied in a linear manner as a function of the rail pressure, rather than as a step-change function. In other words, if rail pressure is increased for a second injection event compared with the previous injection event, the injector is controlled so that the differential voltage across the injector at the end of the charging phase is increased in proportion to the increase in rail pressure by adjusting the charge time (T3 to T4') appropriately. As described previously, the ECU 22 selects an appropriate, reduced charging time from data stored in its memory by first determining (from a look-up table or data map) the differential voltage that is required across the injector for the measured rail pressure. The ECU 22 then determines (from a look-up table or data map) the appropriate charging time that will result in this differential voltage.

The method described previously utilises an open loop charge control strategy to achieve the third differential voltage. In another embodiment, a closed loop charge control strategy may be used whereby the charge across the actuator is measured repeatedly, throughout the charge phase, by monitoring the voltage across the actuator to determine the charge level (i.e. using Q=C×V where Q=charge, C=capacitance and V=voltage). The charge current is applied to the actuator until such time as the desired charge (corresponding to the selected third differential voltage level) is achieved.

In another variation, a closed loop voltage control strategy may be used whereby the voltage is measured throughout the charge phase and the charging current is terminated when it is determined that the selected third differential voltage level has been achieved across the actuator.

In another embodiment, the value of the high voltage rail may be varied in accordance with the measured rail pressure in order to vary the differential voltage across the injector. For example, if the rail pressure just prior to an injection event is less than 500 bar, the voltage applied to the high voltage rail is set at 150V whereas if rail pressure is measured to be greater than or equal to 500 bar, the voltage applied to the high voltage rail is set at 250V. The level of the high voltage rail influences the differential voltage across the injector. The ECU 22 performs the task of monitoring the engine parameters and configuring the value of the high voltage rail.

By way of example, our co-pending European patent application EP 06253619.8 describes a method in which the voltage on the first charge storage capacitor, $V_{C1}$, can be varied through use of a regeneration switch circuitry (not shown) forming part of the drive circuit 26. The regeneration switch circuitry comprises a regeneration switch which is operable by the ECU 22 to vary the charge that is returned to the first storage capacitor C1 during a regeneration phase which occurs at the end of an injection event. The charge on the first storage capacitor Cl determines the level of the high voltage rail, $V_{HI}$. Therefore, one way of adjusting the level of the high voltage rail $V_{HI}$ in accordance with the present invention is to adjust the time for which the regeneration circuitry is operated, so as to charge the storage capacitor C1, and hence to set the high voltage rail $V_{HI}$, to a level to which it is appropriate to recharge the stack, given the measured rail pressure.

In a variation of the method described above, the high voltage rail may be varied linearly in proportion to the measured rail pressure, rather than in a step-change manner.

The invention claimed is:

1. A drive arrangement for a fuel injector including a piezoelectric actuator having a stack of piezoelectric elements, the drive arrangement comprising:

a first element or elements for applying a discharge current ($I_{DISCHARGE}$) to the actuator for a discharge period so as to discharge the stack from a first differential voltage level across the stack to a second differential voltage level across the stack so as to initiate an injection event, a second element or elements for applying a charge current ($I_{CHARGE}$) to the actuator for a charge period (T3 to T4') so as to charge the stack from the second differential voltage level to a third differential voltage level so as to terminate the injection event, a third element or elements for determining at least one engine parameter prior to applying the charge current ($I_{CHARGE}$) to the actuator such that the third differential voltage level to which the stack is charged is selected in dependence on the at least one engine parameter.

2. A method of operating a fuel injector including a piezoelectric actuator having a stack of piezoelectric elements, the method comprising:

applying a discharge current ($I_{DISCHARGE}$) to the actuator for a discharge period so as to discharge the stack from a first differential voltage level across the stack to a second differential voltage level across the stack so as to initiate an injection event, and applying a charge current ($I_{CHARGE}$) to the actuator for a charge period (T3 to T4') so as to charge the stack from the second differential voltage level to a third differential voltage level so as to terminate the injection event, wherein at least one engine parameter is determined prior to applying the charge current ($I_{CHARGE}$) to the actuator and the third differential voltage level is selected in dependence on the at least one engine parameter.

3. The method as claimed in claim 2, wherein the step of determining the at least one engine parameter includes measuring the at least one engine parameter prior to the start of the discharge period.

4. The method as claimed in claim 2, wherein the step of determining the at least one engine parameter includes measuring the at least one engine parameter during the discharge period.

5. The method as claimed in claim 2, wherein the step of determining the at least one engine parameter includes measuring the at least one engine parameter after the discharge period.

6. The method as claimed in claim 2, wherein the third differential voltage level is selected as a function of fuel pressure within a common rail of the engine.

7. The method as claimed in claim 2, comprising selecting a charge time for which the charge current is applied so as to achieve the selected third differential voltage level, the selection of the charge time being carried out subsequent to the selection of the third differential voltage level in dependence on the at least one engine parameter.

8. The method as claimed in claim 2, comprising, subsequent to selecting the third differential voltage level in dependence on the at least one engine parameter, adjusting the level of a voltage source ($V_{HI}$) for applying a differential voltage across the stack so as to achieve the selected third differential voltage level.

9. The method as claimed in claim 2, wherein the third differential voltage level is selected from a look-up table or data map of calibration data.

10. The method as claimed in claim 2, wherein the third differential voltage level is a step-change function or a linear function of the at least one engine parameter.

11. The method as claimed in claim 2, wherein the third differential voltage level is selected as a function of one or more of engine load, engine speed and throttle position.

12. A computer program product comprising at least one computer program software portion which, when executed in an executing environment, is operable to implement the method of claim 2.

13. A data storage medium having the or each computer software portion of claim 12 stored thereon.

14. The microcomputer provided with the data storage medium of claim 13.

15. A method of operating a fuel injector including a piezoelectric actuator having a stack of piezoelectric elements, the method comprising:

applying a discharge current ($I_{DISCHARGE}$) to the actuator for a discharge period so as to discharge the stack from a first differential voltage level across the stack to a second differential voltage level across the stack so as to initiate an injection event, applying a charge current ($I_{CHARGE}$) to the actuator for a charge period (T3 to T4') so as to charge the stack from the second differential voltage level to a third differential voltage level so as to terminate the injection event, determining at least one engine parameter prior to applying the charge current ($I_{CHARGE}$) to the actuator, selecting the third differential voltage level in dependence on the at least one engine parameter, and adjusting the level of a voltage source ($V_{HI}$) for applying a differential voltage across the stack so as to achieve the selected third differential voltage level.

16. The method as claimed in claim 15, wherein the third differential voltage level is a step-change function or a linear function of the at least one engine parameter.

17. The method as claimed in claim 15, wherein the third differential voltage level is selected as a function of one or more of engine load, engine speed and throttle position.

18. A method of operating a fuel injector including a piezoelectric actuator having a stack of piezoelectric elements, the method comprising:

applying a discharge current ($I_{DISCHARGE}$) to the actuator for a discharge period so as to discharge the stack from a first differential voltage level across the stack to a second differential voltage level across the stack so as to initiate an injection event, applying a charge current ($I_{CHARGE}$) to the actuator for a charge period (T3 to T4') so as to charge the stack from the second differential voltage level to a third differential voltage level so as to terminate the injection event, determining at least one engine parameter prior to applying the charge current ($I_{CHARGE}$) to the actuator, selecting the third differential voltage level in dependence on the at least one engine parameter, and selecting a charge time for which the charge current is applied so as to achieve the selected third differential voltage level.

19. The method as claimed in claim 18, wherein the third differential voltage level is a step-change function or a linear function of the at least one engine parameter.

20. The method as claimed in claim 18, wherein the third differential voltage level is selected as a function of one or more of engine load, engine speed and throttle position.

* * * * *